US009890724B2

(12) United States Patent
Tanaka et al.

(10) Patent No.: US 9,890,724 B2
(45) **Date of Patent: *Feb. 13, 2018**

(54) CONTROL SYSTEM OF ENGINE

(71) Applicant: Mazda Motor Corporation, Aki-gun, Hiroshima (JP)

(72) Inventors: Kazuaki Tanaka, Higashihiroshima (JP); Hiroshi Tsuboi, Yokohama (JP); Yuusou Sakamoto, Iwakuni (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/008,925

(22) Filed: Jan. 28, 2016

(65) Prior Publication Data

US 2016/0230681 A1 Aug. 11, 2016

(30) Foreign Application Priority Data

Feb. 10, 2015 (JP) ..... 2015-024102

(51) Int. Cl.
*F02D 41/04* (2006.01)
*F02D 41/00* (2006.01)
(Continued)

(52) U.S. Cl.
CPC ..... *F02D 41/045* (2013.01); *F02D 41/0032* (2013.01); *F02D 41/0045* (2013.01);
(Continued)

(58) Field of Classification Search
CPC ..... F02D 41/0032; F02D 41/0045; F02D 41/123; F02D 41/1441; F02D 41/1456;
(Continued)

(56) References Cited

U.S. PATENT DOCUMENTS 5,513,522 A * 5/1996 Seki ..... F02D 41/1495 73/114.71
2007/0012564 A1* 1/2007 Hayashi ..... G01N 27/4175 204/401
(Continued)

FOREIGN PATENT DOCUMENTS

JP 2001090598 A 4/2001
JP 2001241347 A 9/2001
(Continued)

*Primary Examiner* — John Kwon
*Assistant Examiner* — Johnny H Hoang
(74) *Attorney, Agent, or Firm* — Alleman Hall Creasman & Tuttle LLP

(57) ABSTRACT

A control system of an engine in which a purge gas containing evaporated fuel desorbed from a canister is supplied to an intake passage of the engine is provided. The control system includes a deceleration fuel cutoff module for performing a deceleration fuel cutoff to stop a fuel supply from an injector to the engine when a predetermined deceleration fuel cutoff condition is satisfied in a decelerating state of the engine, a purge unit for purging by supplying the purge gas to the intake passage during the deceleration fuel cutoff, an $O_2$ sensor provided in an exhaust passage of the engine, an abnormality determining module for determining an abnormality of the $O_2$ sensor based on a change of an output value of the $O_2$ sensor that is caused by the deceleration fuel cutoff, and a purge restricting module for restricting the purge during the abnormality determination.

11 Claims, 10 Drawing Sheets

(51) Int. Cl.

| | |
|---|---|
| ***F02M 25/08*** | (2006.01) |
| ***F02D 41/12*** | (2006.01) |
| ***F02D 41/14*** | (2006.01) |

(52) U.S. Cl.

CPC ..... *F02D 41/123* (2013.01); *F02D 41/1441* (2013.01); *F02D 41/1456* (2013.01); *F02D 41/1495* (2013.01); *F02M 25/0836* (2013.01); *F02M 25/0854* (2013.01); *F02D 41/1458* (2013.01)

(58) Field of Classification Search

CPC ..... F02D 41/1458; F02D 41/1495; F02M 25/0836; F02M 25/0854; G01M 15/08–15/10

USPC ..... 123/520, 198 DB, 198 F; 701/102, 103, 701/112, 114; 73/114.18, 114.33, 114.34, 73/114.43, 114.73, 114.74

See application file for complete search history.

(56) References Cited

U.S. PATENT DOCUMENTS

| | | | | |
|---|---|---|---|---|
| 2008/0097683 | A1* | 4/2008 | Yasui | F02D 13/0207 701/104 |
| 2016/0032872 | A1* | 2/2016 | Dudar | F02M 25/0809 73/40.5 R |
| 2016/0237926 | A1* | 8/2016 | Tanaka | F02D 41/1454 |

FOREIGN PATENT DOCUMENTS

| | | | |
|---|---|---|---|
| JP | 2002070612 | A | 3/2002 |
| JP | 2006132436 | A | 5/2006 |
| JP | 2007198210 | A | 8/2007 |

* cited by examiner

CONTROL SYSTEM OF ENGINE

BACKGROUND

The present invention relates to a technical field of a control system of an engine in which a purge gas containing evaporated fuel desorbed from a canister is supplied to an intake passage.

Conventionally, arts are known in which when it is determined that evaporated fuel easily overflows from a canister during a deceleration fuel cutoff of an engine, a purge gas containing the evaporated fuel desorbed from the canister is supplied to an intake passage of the engine. For example, JP2007-198210A discloses such an art. By supplying the purge gas to the intake passage during the deceleration fuel cutoff as above, the overflow of the evaporated fuel from the canister can be suppressed. Although the evaporated fuel within the purge gas supplied to the intake passage will be discharged unburned to an exhaust passage through the engine, the unburned evaporated fuel can be purified by an exhaust emission control catalyst provided in the exhaust passage.

Further, in JP2007-198210A, a linear $O_2$ sensor for detecting an oxygen concentration within exhaust gas for the purpose of performing a feedback control of an air-fuel ratio within a combustion chamber is provided upstream of the exhaust emission control catalyst, and an $O_2$ sensor is provided downstream of the exhaust emission control catalyst.

Meanwhile, the $O_2$ sensor located downstream of the exhaust emission control catalyst is normally for detecting whether a state of the air-fuel ratio of the exhaust gas is stoichiometric, rich, or lean. When the air-fuel ratio is stoichiometric or rich, an output value (output voltage) of the $O_2$ sensor indicates a first voltage (e.g., approximately 1V), and when the air-fuel ratio is lean, the output value indicates a second voltage (e.g., approximately 0V) which is lower than the first voltage. Therefore, in a situation where the exhaust gas passing through the $O_2$ sensor is assumed to be rich immediately before the deceleration fuel cutoff, when the deceleration fuel cutoff is performed in this situation, due to the deceleration fuel cutoff, the output value of the $O_2$ sensor changes from the first voltage to the second voltage in a short period of time in an early stage of the deceleration fuel cutoff.

Here, there is a case where an abnormality occurs in the $O_2$ sensor and a speed of a change of the output value of the $O_2$ sensor (a speed of the change from the first voltage to the second voltage) caused by the deceleration fuel cutoff becomes lower or the output value does not reduce to the second voltage. Therefore, determining whether the $O_2$ sensor is abnormal (performing an abnormality determination), based on the change of the output value of the $O_2$ sensor caused by the deceleration fuel cutoff, may be considered. For example, when the speed of the change of the output value of the $O_2$ sensor caused by the deceleration fuel cutoff (e.g., the changing speed between the first (high) and second (low) voltages (i.e., a changing period of time between the two voltages) is lower than a predetermined speed (longer than a predetermined period of time), the $O_2$ sensor is determined to be abnormal.

However, by supplying the purge gas to the intake passage of the engine during the deceleration fuel cutoff (performing a purge) as JP2007-198210A does, the purge is performed also during the abnormality determination, and due to the existence of the evaporated fuel within the purge gas, the speed of the change of the output value of the $O_2$ sensor caused by the deceleration fuel cutoff becomes lower. As a result, even if the $O_2$ sensor is normal, it may be falsely determined as abnormal.

SUMMARY

The present invention is made in view of the above situations and aims to suppress degradation in accuracy of an abnormality determination of an $O_2$ sensor of an engine due to a purge during a deceleration fuel cutoff of the engine when an abnormality of the $O_2$ sensor is determined based on a change of an output value of the $O_2$ sensor caused by the deceleration fuel cutoff.

According to one aspect of the present invention, a control system of an engine in which a purge gas containing evaporated fuel desorbed from a canister is supplied to an intake passage of the engine, is provided. The control system includes a deceleration fuel cutoff module for performing a deceleration fuel cutoff to stop a fuel supply from an injector to the engine when a predetermined deceleration fuel cutoff condition is satisfied in a decelerating state of the engine, a purge unit for performing a purge by supplying the purge gas to the intake passage during the deceleration fuel cutoff, an $O_2$ sensor provided in an exhaust passage of the engine, an abnormality determining module for performing an abnormality determination by determining an abnormality of the $O_2$ sensor based on a change of an output value of the $O_2$ sensor that is caused by the deceleration fuel cutoff, and a purge restricting module for restricting the purge during the abnormality determination.

With this configuration, since the purge restricting module restricts the purge during the abnormality determination (e.g., prohibits the purge, or restricts a supply amount of the purge gas to the intake passage), degradation in accuracy of the abnormality determination due to the purge can be suppressed.

During the abnormality determination, the purge restricting module may restrict the purge so that an air-fuel ratio within a combustion chamber of the engine exceeds a predetermined ratio.

Thus, when the purge is performed during the abnormality determination, the purge restricting module can restrict the purge so as not to influence a speed of the change of the output value of the $O_2$ sensor caused by the deceleration fuel cutoff. Further, by purging during the abnormality determination, the supply amount of the purge gas to intake passage can be secured as much as possible.

The control system may further include an air-fuel ratio estimating module for estimating an air-fuel ratio within a combustion chamber of the engine during the abnormality determination in a case where the purge is performed during the abnormality determination. The purge restricting module may prohibit the purge during the abnormality determination when the estimated air-fuel ratio is below a preset ratio.

Specifically, when the air-fuel ratio within the combustion chamber is below the preset ratio, the purge greatly influences the changing speed of the output value of the $O_2$ sensor caused by the deceleration fuel cutoff. However, in such a case, the purge is prohibited. Therefore, degradation in accuracy of the abnormality determination of the $O_2$ sensor due to the purge can securely be suppressed.

In the control system, the purge unit preferably includes a purge line through which the canister communicates with the intake passage, a purge valve provided in the purge line, and a purge valve controlling module for controlling a supply amount of the purge gas to the intake passage by performing a duty control of the purge valve when the purge is performed. The control system preferably further includes an evaporated fuel concentration estimating module for estimating a concentration of the evaporated fuel within the purge gas when the purge is performed during the abnormality determination. During the abnormality determination, the purge restricting module preferably restricts the supply amount of the purge gas to the intake passage based on the estimated concentration of the evaporated fuel.

Specifically, when the concentration of the evaporated fuel within the purge gas is high, the purge easily lowers the changing speed of the output value of the $O_2$ sensor caused by the deceleration fuel cutoff. However, in such a case, the purge restricting module restricts the supply amount of the purge gas to the intake passage controlled by the purge valve controlling module, based on the estimated concentration of the evaporated fuel. Therefore, the supply amount is restricted so that the changing speed is not lowered, and degradation in accuracy of the abnormality determination of the $O_2$ sensor can be suppressed. Further, the air-fuel ratio within the combustion chamber easily changes due to the duty control of the purge valve. However, when the purge is restricted by the air-fuel ratio as described above, by taking into consideration the change of the air-fuel ratio, the purge can more suitably be restricted.

When the estimated concentration of the evaporated fuel is above a predetermined concentration, the purge restricting module preferably prohibits the purge during the abnormality determination.

Specifically, when the concentration of the evaporated fuel is too high, the purge greatly influences the changing speed of the output value of the $O_2$ sensor caused by the deceleration fuel cutoff. However, in such a case, the purge restricting module prohibits the purge (i.e., the supply amount of the purge gas to the intake passage is reduced to zero). Therefore, degradation in accuracy of the abnormality determination of the $O_2$ sensor due to the purge can securely be suppressed.

DETAILED DESCRIPTION OF EMBODIMENT

Hereinafter, one embodiment of the present invention is described in detail with reference to the appended drawings.

Figure 1:
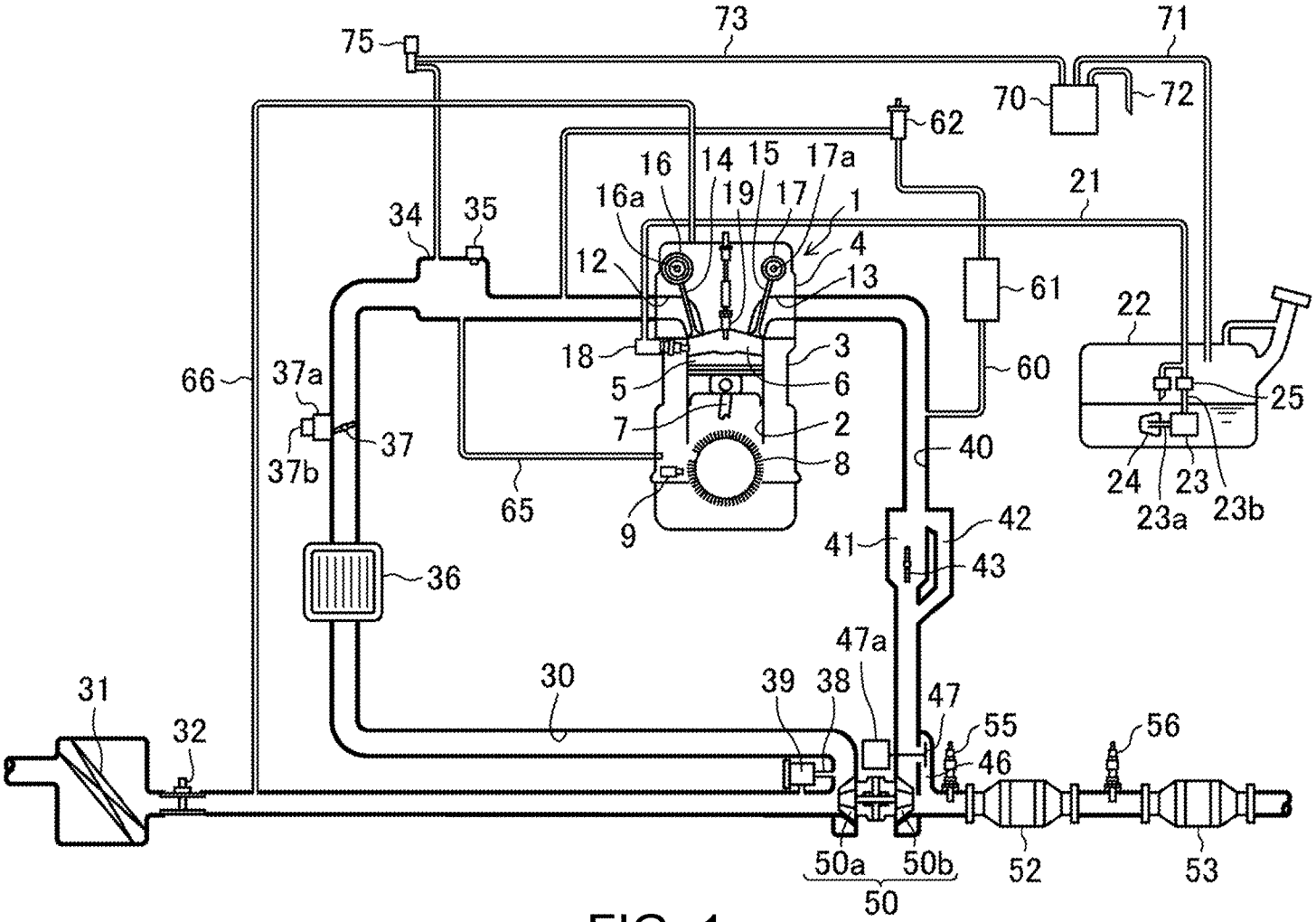
FIG. 1 is a view illustrating a schematic configuration of an engine controlled by a control system according to one embodiment of the present invention.

FIG. 1 is a view illustrating a schematic configuration of an engine 1 controlled by a control system 100 (see FIG. 2) according to one embodiment of the present invention. The engine 1 is a gasoline engine mounted on a vehicle and having a turbocharger. The engine 1 includes a cylinder block 3 where a plurality of cylinders 2 (only one cylinder is illustrated in FIG. 1) are arranged in a line, and a cylinder head 4 disposed on the cylinder block 3. A piston 5 defining a combustion chamber 6 together with the cylinder head 4 therebetween is reciprocatably fitted into each of the cylinders 2 of the engine 1. The piston 5 is coupled to a crankshaft (not illustrated) through a connecting rod 7. To the crankshaft, a detecting plate 8 for detecting a rotational angular position of the crankshaft is fixed to integrally rotate therewith, and an engine speed sensor 9 for detecting a rotational angular position of the detecting plate 8 to detect a speed of the engine 1 is provided.

In the cylinder head 4, an intake port 12 and an exhaust port 13 are formed for each cylinder 2, and an intake valve 14 for opening and closing the intake port 12 on the combustion chamber 6 side and an exhaust valve 15 for opening and closing the exhaust port 13 on the combustion chamber 6 side are provided for each cylinder 2. Each intake valve 14 is driven by an intake valve drive mechanism 16, and each exhaust valve 15 is driven by an exhaust valve drive mechanism 17. The intake valve 14 reciprocates at a predetermined timing by the intake valve drive mechanism 16 to open and close the intake port 12, the exhaust valve 15 reciprocates at a predetermined timing by the exhaust valve drive mechanism 17 to open and close the exhaust port 13, and thus, gas inside the cylinder 2 is exchanged. The intake and exhaust valve drive mechanisms 16 and 17 have an intake camshaft 16*a* and an exhaust camshaft 17*a* which are coupled to the crankshaft to be drivable, respectively. The camshafts 16*a* and 17*a* rotate in synchronization with the rotation of the crankshaft. Moreover, the intake valve drive mechanism 16 includes a hydraulically/mechanically-driven phase variable mechanism (Variable Valve Timing: VVT) for varying a phase of the intake camshaft 16*a* within a predetermined angle range.

An injector 18 for injecting fuel (in this embodiment, gasoline) is provided in an upper (cylinder head 4 side) end part of the cylinder block 3, for each cylinder 2. The injector 18 is disposed such that a fuel injection port thereof is oriented toward an inside of the combustion chamber 6, and directly injects the fuel into the combustion chamber 6 near a top dead center of compression stroke (CTDC). Note that the injectors 18 may be provided to the cylinder head 4.

The injectors 18 are connected to a fuel tank 22 via a fuel supply tube 21. Inside the fuel tank 22, a fuel pump 23 is disposed to be submerged in the fuel. The fuel pump 23 has a suction tube 23*a* for sucking the fuel, and a discharge tube 23*b* for discharging the sucked fuel. The suction tube 23*a* has a strainer 24 at its tip. The discharge tube 23*b* is connected to the injectors 18 via a regulator 25. The fuel pump 23 sucks the fuel with the suction tube 23*a* and then discharges the fuel with the discharge tube 23*b* for a pressure adjustment at the regulator 25, so as to send the fuel to the injectors 18. Specifically, the fuel supply tube 21 is connected to a fuel distribution tube (not illustrated) extending in a cylinder row direction; the fuel distribution tube is connected to the injectors 18 of the respective cylinders 2, and thus, the fuel from the fuel pump 23 is distributed to the injectors 18 of the respective cylinders 2 by the fuel distribution tube.

Inside the cylinder head 4, an ignition plug 19 is disposed for each cylinder 2. A tip part (electrode) of the ignition plug 19 is located near a ceiling of the combustion chamber 6. Further, the ignition plug 19 produces a spark at a predetermined ignition timing, and thus mixture gas of the fuel and air is combusted in response to the spark.

On one side surface of the engine 1, an intake passage 30 is connected to communicate with the intake ports 12 of the cylinders 2. An air cleaner 31 for filtrating intake air is disposed in an upstream end part of the intake passage 30, and the intake air filtered by the air cleaner 31 is supplied to the combustion chambers 6 of the respective cylinders 2 via the intake passage 30 and the intake ports 12.

An airflow sensor 32 for detecting a flow rate of the intake air sucked into the intake passage 30 is disposed at a position of the intake passage 30 near the downstream side of the air cleaner 31. Further, a surge tank 34 is disposed near a downstream end of the intake passage 30. Part of the intake passage 30 downstream of the surge tank 34 is branched into independent passages extending toward the respective cylinders 2, and downstream ends of the independent passages are connected to the intake ports 12 of the cylinders 2, respectively. A pressure sensor 35 for detecting pressure inside the surge tank 34 is disposed in the surge tank 34.

Moreover, in the intake passage 30, a compressor 50*a* of a turbocharger 50 is disposed between the airflow sensor 32 and the surge tank 34. The intake air is turbocharged by the compressor 50*a* in operation.

Furthermore, in the intake passage 30, an intercooler 36 for cooling air compressed by the compressor 50*a*, and a throttle valve 37 are arranged between the compressor 50*a* of the turbocharger 50 and the surge tank 34 in this order from the upstream side. The throttle valve 37 is driven by a drive motor 37*a* to change a cross-sectional area of the intake passage 30 at the disposed position of the throttle valve 37, so as to adjust an amount of intake air flowing into the combustion chambers 6 of the respective cylinders 2. An opening of the throttle valve 37 is detected by a throttle opening sensor 37*b*.

Additionally in this embodiment, an intake bypass passage 38 for bypassing the compressor 50*a* is provided to the intake passage 30, and an air bypass valve 39 is provided in the intake bypass passage 38. The air bypass valve 39 is normally fully closed, but for example when the opening of the throttle valve 37 is sharply reduced, a sharp increase and sharp surging of pressure occur in the part of the intake passage 30 upstream of the throttle valve 37 and the rotation of the compressor 50*a* is disturbed, which results in causing a loud noise; therefore the air bypass valve 39 is opened to prevent such a situation.

On the other side surface of the engine 1, an exhaust passage 40 is connected to discharge exhaust gas from the combustion chambers 6 of the cylinders 2. An upstream part of the exhaust passage 40 is comprised of an exhaust manifold having independent passages extending to the respective cylinders 2 and connected to respective external ends of the exhaust ports 13 of the cylinders 2, and a manifold section where the respective independent passages are collected together. A turbine 50*b* of the turbocharger 50 is disposed in part of the exhaust passage 40 downstream of the exhaust manifold. The turbine 50*b* is rotated by the flow of the exhaust gas, and the compressor 50*a* coupled to the turbine 50*b* is operated by the rotation of the turbine 50*b*.

Part of the exhaust passage 40 which is downstream of the exhaust manifold and upstream of the turbine 50*b* is branched into a first passage 41 and a second passage 42. A flow rate changing valve 43 for changing a flow rate of the exhaust gas flowing toward the turbine 50*b* is provided in the first passage 41. The second passage 42 merges with the first passage 41 at a position downstream of the flow rate changing valve 43 and upstream of the turbine 50*b*.

Further, an exhaust bypass passage 46 for guiding the exhaust gas of the engine 1 to flow while bypassing the turbine 50*b* is provided in the exhaust passage 40. An end part of the exhaust bypass passage 46 on the flow-in side of the exhaust gas (an upstream end part of the exhaust bypass passage 46) is connected to a position of the exhaust passage 40 between the merging section of the first and second passages 41 and 42 in the exhaust passage 40 and the turbine 50*b*. An end part of the exhaust bypass passage 46 on the flow-out side of the exhaust gas (a downstream end part of the exhaust bypass passage 46) is connected to a position of the exhaust passage 40 downstream of the turbine 50*b* and upstream of an upstream exhaust emission control catalyst 52 (described later).

The end part of the exhaust bypass passage 46 on the flow-in side of the exhaust gas is provided with a wastegate valve 47 that is driven by a drive motor 47*a*. The wastegate valve 47 is controlled by the control system 100 according to an operating state of the engine 1. When the wastegate valve 47 is fully closed, the entire amount of exhaust gas flows to the turbine 50*b*, and when the wastegate valve 47 is not fully closed, the flow rate of the exhaust gas to the exhaust bypass passage 46 (i.e., the flow rate of the exhaust gas to the turbine 50*b*) changes according to the opening of the wastegate valve 47. In other words, as the opening of the wastegate valve 47 becomes larger, the flow rate of the exhaust gas to the exhaust bypass passage 46 becomes higher and the flow rate of the exhaust gas to the turbine 50*b* becomes lower. When the wastegate valve 47 is fully opened, the turbocharger 50 substantially does not operate.

Part of the exhaust passage 40 downstream of the turbine 50*b* (downstream of the position connected to the downstream end part of the exhaust bypass passage 46) is provided with exhaust emission control catalysts 52 and 53 constructed with an oxidation catalyst, etc., and for purifying hazardous components contained within the exhaust gas (and unburned evaporated fuel during a deceleration fuel cutoff described later). In this embodiment, the two exhaust emission control catalysts of the upstream exhaust emission control catalyst 52 and the downstream exhaust emission control catalyst 53 are provided. However, just the upstream exhaust emission control catalyst 52 may be provided instead.

In the exhaust passage 40, a linear $O_2$ sensor 55 having an output property which is linear with respect to an oxygen concentration within the exhaust gas is disposed near the upstream side of the upstream exhaust emission control catalyst 52. The linear $O_2$ sensor 55 is an air-fuel ratio sensor for detecting the oxygen concentration within the exhaust gas for the purpose of performing a feedback control of an air-fuel ratio within the combustion chambers 6. Further in the exhaust passage 40, an $O_2$ sensor 56 for detecting a state of the air-fuel ratio of the exhaust gas which has passed through the upstream exhaust emission control catalyst 52 among stoichiometric, rich or lean is disposed between the upstream and downstream exhaust emission control catalysts 52 and 53. In this embodiment, when the air-fuel ratio is stoichiometric or rich, an output value (output voltage) of the $O_2$ sensor 56 indicates a first voltage (e.g., approximately 1V), and when the air-fuel ratio is lean, the output value indicates a second voltage (e.g., approximately 0V) which is lower than the first voltage.

The engine 1 includes an EGR passage 60 for recirculating part of the exhaust gas from the exhaust passage 40 to the intake passage 30. The EGR passage 60 connects the part of the exhaust passage 40 upstream of the branched section of the first and second passages 41 and 42 to the independent passages of the intake passage 30 downstream of the surge tank 34. An EGR cooler 61 for cooling the exhaust gas passing therethrough and an EGR valve 62 for adjusting an amount of the exhaust gas recirculated by the EGR passage 60 are disposed in the EGR passage 60.

The engine 1 also includes first and second ventilation hoses 65 and 66 for returning back to the intake passage 30 blow-by gas leaked from the combustion chambers 6. The first ventilation hose 65 connects a lower part (crank case) of the cylinder block 3 to the surge tank 34, and the second ventilation hose 66 connects an upper part of the cylinder head 4 to part of the intake passage 30 between the air cleaner 31 and the compressor 50*a*.

The fuel tank 22 is connected to a canister 70 containing an adsorbent (e.g., activated charcoal) therein, via a connecting tube 71. Fuel evaporated inside the fuel tank 22 flows to the canister 70 via the connecting tube 71 and is trapped by the canister 70 (adsorbent). An inside of the canister 70 communicates with ambient air via an ambient air communicating tube 72.

The canister 70 is connected to the intake passage 30 via a purge tube 73 (purge line). In this embodiment, an end part of the purge tube 73 on the intake passage 30 side is connected to the surge tank 34 provided downstream of the compressor 50*a* in the intake passage 30.

The purge tube 73 is provided with a purge valve 75. When the purge valve 75 is opened and the pressure inside the surge tank 34 is negative (i.e., when the intake air is not turbocharged by the compressor 50*a* of the turbocharger 50), the ambient air (air) is introduced into the ambient air communicating tube 72, the evaporated fuel trapped in the canister 70 is desorbed therefrom by the flow of the air, and then the desorbed evaporated fuel is supplied along with the air as purge gas, to the surge tank 34 (a purge is performed). A supply amount (or a supply flow rate) of the purge gas to the surge tank 34 (intake passage 30) is determined based on an opening of the purge valve 75 and a pressure difference Pd between the pressure inside the surge tank 34 (the pressure detected by the pressure sensor 35) and atmospheric pressure (pressure detected by an atmospheric pressure sensor 91 described later).

Figure 2:
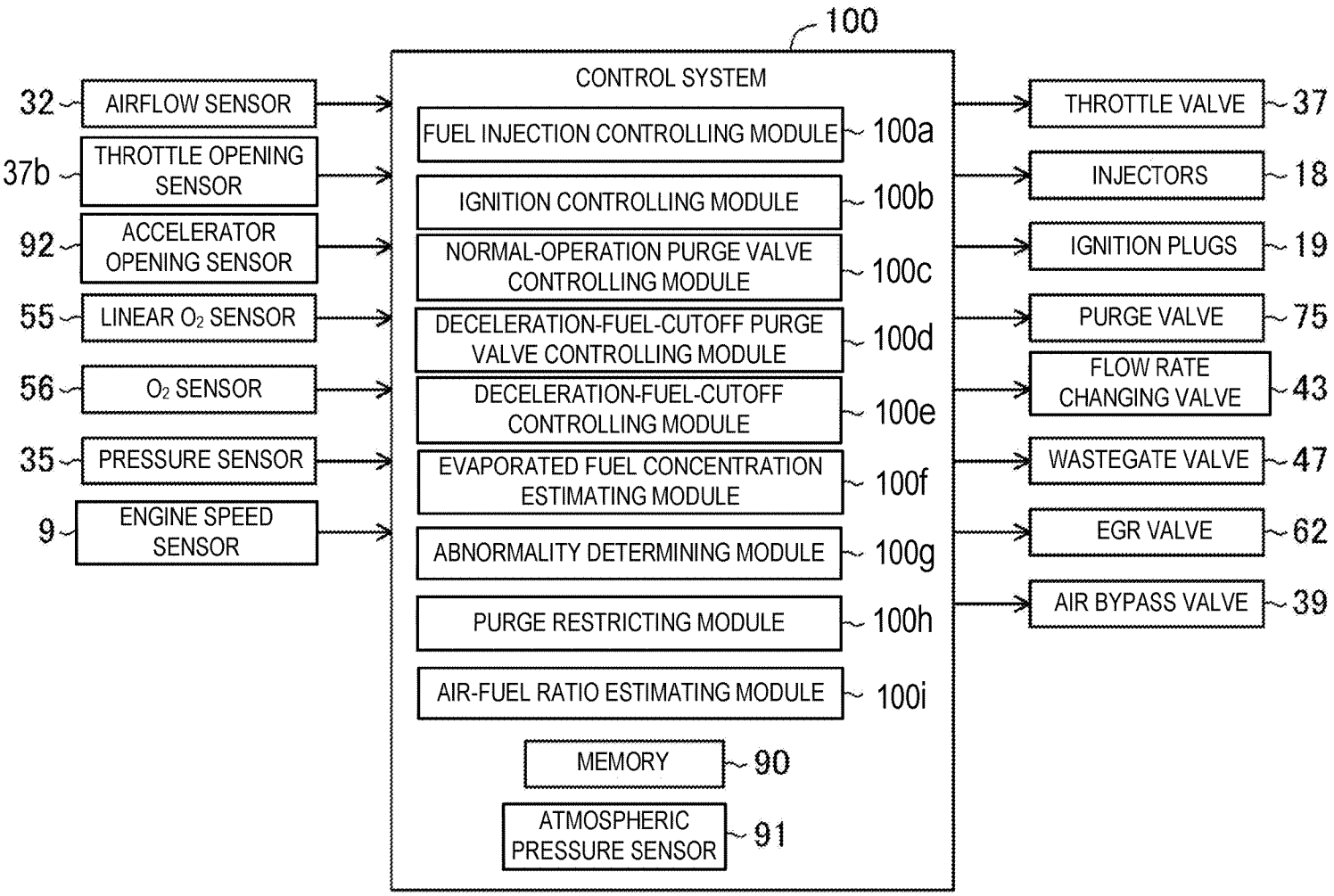
FIG. 2 is a block diagram illustrating a configuration of the control system of the engine.

As illustrated in FIG. 2, operations of the throttle valve 37 (specifically, the drive motor 37*a*), the injectors 18, the ignition plugs 19, the purge valve 75, the flow rate changing valve 43, the wastegate valve 47 (specifically, the drive motor 47*a*), the EGR valve 62, and the air bypass valve 39 are controlled by the control system 100. The control system 100 is a controller based on a well-known microcomputer, and includes a central processing unit (CPU) for executing program(s), a memory 90 comprised of, for example, a RAM and/or a ROM and for storing the program(s) and data, and an input/output (I/O) bus for inputting and outputting electric signals (FIG. 2 only illustrates the memory 90 thereamong).

The control system 100 receives signals indicating output values of various sensors including the airflow sensor 32, the throttle opening sensor 37*b*, an accelerator opening sensor 92 for detecting a stepping amount of an acceleration pedal (accelerator opening) by a driver of the vehicle on which the engine 1 is mounted, the linear $O_2$ sensor 55, the $O_2$ sensor 56, the pressure sensor 35, and the engine speed sensor 9. In this embodiment, the control system 100 is provided with the atmospheric pressure sensor 91 for detecting the atmospheric pressure. The control system 100 controls the operations of the valves described above, based on the output values of the various sensors. Specifically, the operation control of the injectors 18 (fuel injection control) is performed by a fuel injection controlling module 100*a* of the control system 100, the operation control of the ignition plugs 19 is performed by an ignition controlling module 100*b* of the control system 100, and the operation control of the purge valve 75 (opening control, i.e., the control of the supply amount of the purge gas to the surge tank 34) is performed by one of a normal-operation purge valve controlling module 100*c* and a deceleration-fuel-cutoff purge valve controlling module 100*d* of the control system 100. Note that the operation control of the purge valve 75 by one of the normal-operation purge valve controlling module 100*c* and the deceleration-fuel-cutoff purge valve controlling module 100*d* of the control system 100 is performed through a control of a duty ratio of a control signal transmitted to the purge valve 75 (a duty control of the purge valve 75).

The control system 100 also includes a deceleration-fuel-cutoff controlling module 100*e* (deceleration fuel cutoff module), an evaporated fuel concentration estimating module 100*f*, an abnormality determining module 100*g*, a purge restricting module 100*h*, and an air-fuel ratio estimating module 100*i*, which are described later in detail.

When a predetermined deceleration fuel cutoff condition is satisfied while the engine 1 is in a decelerating state, the deceleration-fuel-cutoff controlling module 100*e* performs a deceleration fuel cutoff to stop the fuel supply from the injectors 18 to the engine 1. The predetermined deceleration fuel cutoff condition is, for example, a condition in which the opening of the throttle valve 37 is detected by the throttle opening sensor 37*b* to be fully closed and the speed of the engine 1 is detected by engine speed sensor 9 to be above a predetermined speed (slightly above an idling speed). During the deceleration fuel cutoff, the injectors 18 and the ignition plugs 19 are not operated.

During the deceleration fuel cutoff, the deceleration-fuel-cutoff purge valve controlling module 100*d* controls the operation of the purge valve 75 (the supply amount of the purge gas to the surge tank 34). Specifically, the purge by supplying the purge gas to the surge tank 34 is performed during a normal operation of the engine 1 (operation in which the fuel is injected by the injectors 18 and the injected fuel is ignited by the ignition plugs 19) and also during the deceleration fuel cutoff. The operation control of the purge valve 75 during the deceleration fuel cutoff is described later. In this embodiment, the purge tube 73 (purge line), the purge valve 75, and the deceleration-fuel-cutoff purge valve controlling module 100*d* (purge valve controlling module) constitute a purge unit for purging by supplying the purge gas to the intake passage 30 of the engine 1 during the deceleration fuel cutoff.

On the other hand, during the normal operation of the engine 1 (other than the deceleration fuel cutoff), the normal-operation purge valve controlling module 100*c* controls the operation of the purge valve 75 according to the operating state of the engine 1. In this embodiment, when the engine 1 is in an operating state where the turbocharger 50 is operated to turbocharge the intake air, since the pressure inside the surge tank 34 is not negative, the normal-operation purge valve controlling module 100*c* fully closes the purge valve 75, and when the engine 1 is in an operating state where the turbocharger 50 is not operated, the normal-operation purge valve controlling module 100*c* performs the purge.

When the purge is performed during the normal operation of the engine 1, the evaporated fuel concentration estimating module 100*f* learns by estimation a concentration of the evaporated fuel within the purge gas based on a feedback correction amount of the air-fuel ratio obtained based on the output value of the linear $O_2$ sensor 55, and the evaporated fuel concentration estimating module 100*f* stores (updates) the learned value of the concentration of the evaporated fuel in the memory 90. The fuel injection controlling module 100*a* corrects the fuel injection amount based on the feedback correction amount and the learned value.

In other words, a shift of the air-fuel ratio within the combustion chambers 6 caused by supplying the purge gas (evaporated fuel) to the surge tank 34 of the intake passage 30 is detected by the linear $O_2$ sensor 55. The fuel injection controlling module 100*a* performs the feedback correction of the air-fuel ratio (i.e., fuel injection amount) based on the detected value (output value), and corrects the fuel injection amount according to the learned value of the concentration of the evaporated fuel, so as to compensate for a response lag of the feedback correction.

In this embodiment, the evaporated fuel concentration estimating module 100*f* estimates the concentration of the evaporated fuel within the purge gas when the purge is performed during the deceleration fuel cutoff, to be the learned value immediately before the deceleration fuel cutoff (the latest learned value stored in the memory 90). Even in this manner, a period of time for which the deceleration fuel cutoff is performed continuously is comparatively short and a possibility of the concentration of the evaporated fuel greatly changing during the time period is low, therefore no problem will occur.

Figure 3:
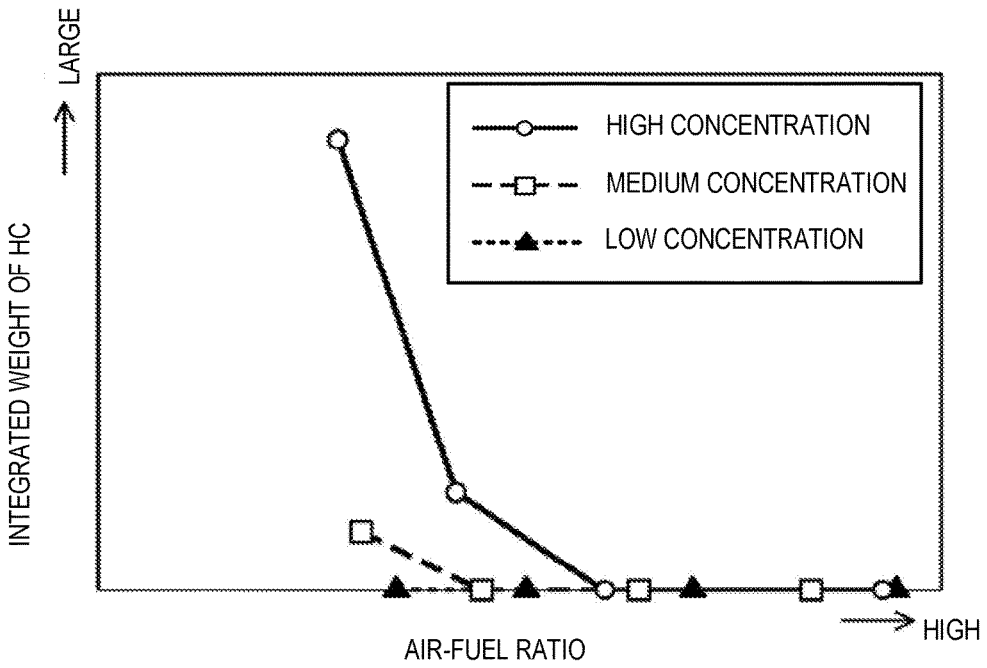
FIG. 3 is a chart illustrating relationships between an air-fuel ratio within combustion chambers and an integrated weight of hydrocarbons (HC) which have passed through a downstream exhaust emission control catalyst, for cases where a concentration (learned value) of evaporated fuel indicates a high concentration, a medium concentration, and a low concentration, respectively.
Figure 4:
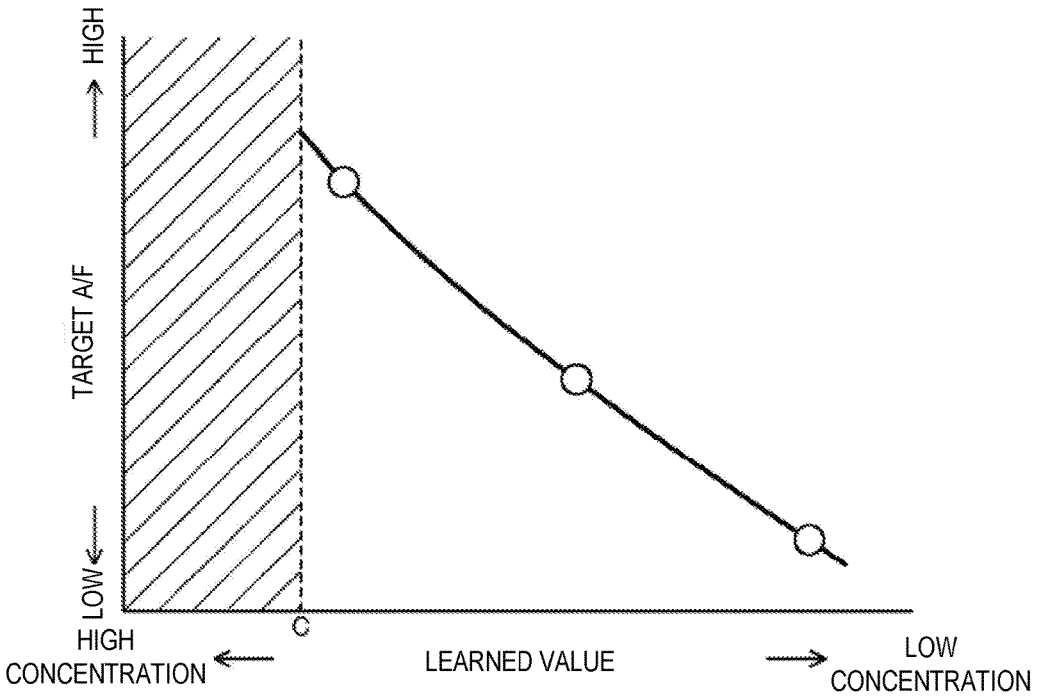
FIG. 4 is a chart illustrating a first map indicating a relationship between the learned value of the concentration of the evaporated fuel and a target air-fuel ratio (A/F).

The deceleration-fuel-cutoff purge valve controlling module 100*d* first calculates a target air-fuel ratio (target A/F) when the purge is performed during the deceleration fuel cutoff. FIG. 3 is a chart illustrating relationships between the air-fuel ratio within the combustion chambers 6 and an integrated weight of HC which has passed through the downstream exhaust emission control catalyst 53, for cases where the concentration (learned value) of the evaporated fuel indicates a high concentration, a medium concentration, and a low concentration, respectively. From FIG. 3, it can be understood that at each concentration, the integrated weight of HC is reduced as the air-fuel ratio becomes higher, and when the air-fuel ratio exceeds a certain ratio, the integrated weight of HC becomes 0 (zero). Therefore, the target A/F may be set to be a ratio equal to or larger than a smallest air-fuel ratio at which the integrated weight of HC becomes 0 at each concentration (preferably be a ratio equal or close to the smallest air-fuel ratio, in view of increasing the supply amount of the purge gas to the surge tank 34 as much as possible when the purge is performed). The relationship between the learned value and the target A/F is stored in the memory 90 in advance in a form of a first map as illustrated in FIG. 4, and by using the first map, the target A/F is calculated based on the learned value obtained immediately before the deceleration fuel cutoff. Note that in the first map, the target A/F is not set for when the learned value indicates a concentration higher than a preset concentration C (the hatched section in FIG. 4), in other words, when the learned value indicates a concentration high enough that the evaporated fuel cannot suitably be purified by the exhaust emission control catalysts 52 and 53. In this case, the deceleration-fuel-cutoff purge valve controlling module 100*d* does not perform the purge (i.e., it fully closes the purge valve 75) during the deceleration fuel cutoff.

Further, a mass ratio ra of the evaporated fuel with respect to the entirety of the purge gas is calculated based on the learned value. A total air mass qa sucked into the combustion chambers 6 and discharged to the exhaust passage 40 when the purge is performed during the deceleration fuel cutoff is calculated based on the output value of the airflow sensor 32, the mass ratio ra, and the output value of the linear $O_2$ sensor 55.

When a mass of the evaporated fuel inside the combustion chambers 6 (same as the mass of the evaporated fuel within the purge gas) is "ggas,"

$$\text{target } A/F = qa/\text{ggas}.$$

Based on such a relationship, $$\text{ggas} = qa/(\text{target } A/F).$$

The mass ggas of the evaporated fuel inside the combustion chambers 6 is calculated by substituting the calculated values of the target A/F and the total air mass qa into this equation.

Further, when a mass of air within the purge gas is "gair,"

$$(1-ra):ra = \text{gair}:\text{ggas}.$$

Thus, $$\text{gair} = \text{ggas} \times (1-ra)/ra.$$

Based on this equation, the mass gair of the air within the purge gas is calculated.

When a total mass of the evaporated fuel and the air within the purge gas is "gprg,"

$$gprg = \text{ggas} + \text{gair}.$$

A purge gas volume qprg corresponding to the total mass gprg converted into volume is, with a density of the purge gas as cp, $$qprg = gprg \times cp.$$

Note that a value corresponding to the mass ratio ra of the evaporated fuel with respect to the entirety of the purge gas is stored in the memory 90 in advance as the density cp of the purge gas.

The deceleration-fuel-cutoff purge valve controlling module 100*d* controls the supply amount of the purge gas to the surge tank 34 (the opening of the purge valve 75) when the purge is performed during the deceleration fuel cutoff, based on the purge gas volume qprg and the pressure difference Pd.

The abnormality determining module 100*g* determines whether the $O_2$ sensor 56 is abnormal (performs an abnormality determination) based on a change of the output value of the $O_2$ sensor 56 (specifically, a response time of the output value of the $O_2$ sensor 56) caused by the deceleration fuel cutoff performed by the deceleration fuel cutoff controlling module 100*e*.

Figure 5:
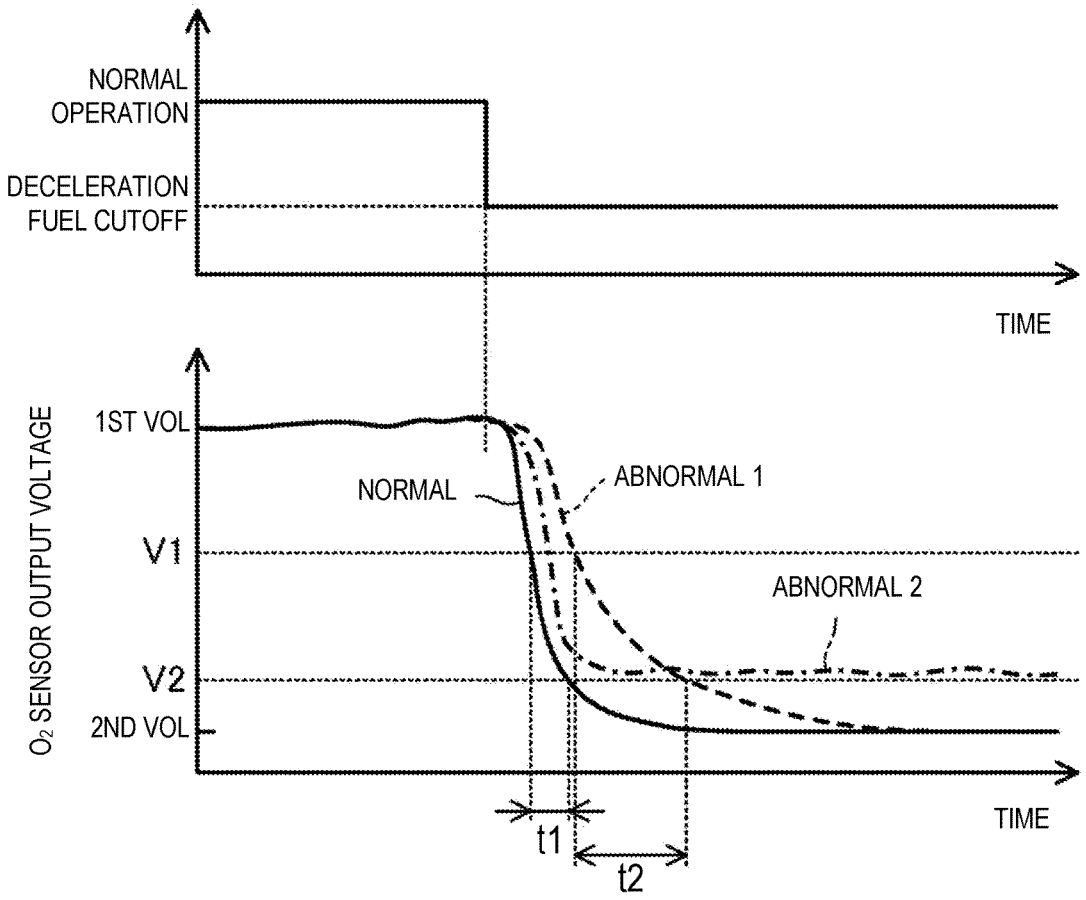
FIG. 5 shows time charts illustrating changes of an output value of an $O_2$ sensor (changes in a normal state and an abnormal state) when a deceleration fuel cutoff is performed in a state where the output value of the $O_2$ sensor is the first voltage during a normal operation of the engine.

As illustrated in FIG. 5, when the deceleration fuel cutoff is performed while the engine 1 is in the normal operation and the output value of the $O_2$ sensor 56 is the first voltage, due to the deceleration fuel cutoff, the output value of the $O_2$ sensor 56 changes from the first voltage to the second voltage in a short period of time in an early stage of the deceleration fuel cutoff, as indicated by the solid line (described as "NORMAL"). When an abnormality occurs in the $O_2$ sensor 56 and the responsiveness degrades, the speed of the change of the output value of the $O_2$ sensor 56 caused by the deceleration fuel cutoff becomes lower (the response time of the output value of the $O_2$ sensor 56 becomes longer) as indicated by the dashed line (described as "ABNORMAL 1"). Based on this, the abnormality determining module 100*g* performs the abnormality determination.

In a first example of the abnormality determination, in the changing process of the output value of the $O_2$ sensor 56 caused by the deceleration fuel cutoff, by having as the response time a period of time ta required for the output value of the $O_2$ sensor 56 to reach from a first voltage threshold V1 to a second voltage threshold V2 (in the example of FIG. 5, ta=t1 in the normal state, and ta=t2 in the abnormal state), the abnormality determining module 100*g* determines that the $O_2$ sensor 56 is normal if the time period ta is shorter than a first predetermined period of time ta0, whereas the abnormality determining module 100*g* determines that the $O_2$ sensor 56 is abnormal if the time period ta is the first predetermined time period ta0 or longer. Here, the first voltage threshold V1 is set between the first and second voltages (when the first voltage is 1V and the second voltage is 0V, the first voltage threshold V1 is 0.55V, for example), and the second voltage threshold V2 is between the first and second voltages and below the first voltage threshold V1 (when the first voltage is 1V and the second voltage is 0V, the second voltage threshold V2 is 0.2V, for example). The first predetermined time period ta0 is set between the time period t1 and the time period t2.

A case where the output value of the $O_2$ sensor 56 does not drop to the second voltage threshold V2 due to the abnormality of the $O_2$ sensor 56 as indicated by the one-dotted chain line (described as "ABNORMAL 2") in FIG. 5, and a case where the output value of the $O_2$ sensor 56 drops to the second voltage threshold V2 after a significantly long period of time from the start of the deceleration fuel cutoff, can be considered. Therefore, in a second example of the abnormality determination, the response time is a period of time tb from the start of the deceleration fuel cutoff until the output value of the $O_2$ sensor 56 reaches a third voltage threshold V3 (a voltage between the first and second voltages and equal or close to the second voltage threshold V2). When the output value of the $O_2$ sensor 56 reaches the third voltage threshold V3 within a second predetermined period of time tb0 from the start of the deceleration fuel cutoff, the abnormality determining module 100*g* determines that the $O_2$ sensor 56 is normal, whereas when the output value of the $O_2$ sensor 56 does not reach the third voltage threshold V3 within the second predetermined time period tb0 from the start of the deceleration fuel cutoff (i.e., the response time is the second predetermined time period tb0 or longer), the abnormality determining module 100*g* determines that the $O_2$ sensor 56 is abnormal.

The first and second predetermined time periods, ta0 and tb0 in the first and second examples, are set in advance under a condition in which the purge is not performed during the abnormality determination. However, when the purge is performed during the abnormality determination, the changing speed of the output value of the $O_2$ sensor 56 becomes lower (the response time of the output value of the $O_2$ sensor 56 becomes longer) due to the existence of the evaporated fuel within the purge gas. As a result, even if the $O_2$ sensor 56 is normal, it may be falsely determined as abnormal.

Therefore, the purge restricting module 100*h* restricts the purge performed by the deceleration-fuel-cutoff purge valve controlling module 100*d* during the abnormality determination performed by the abnormality determining module 100*g*, so as to suppress the false determination.

Figure 6:
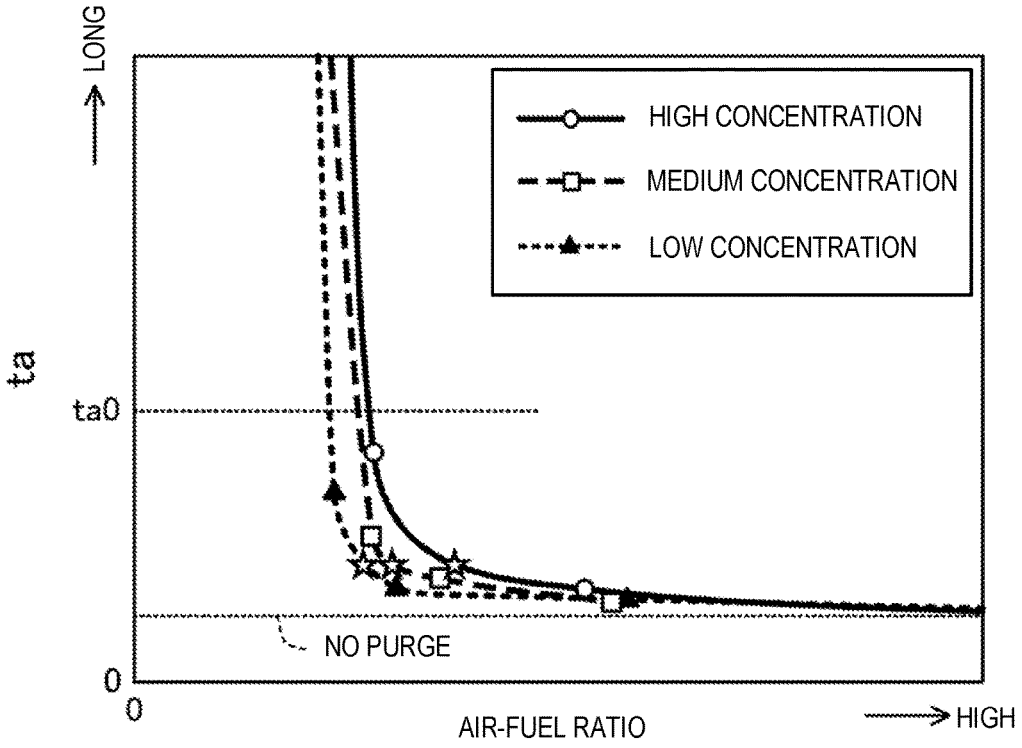
FIG. 6 is a chart illustrating relationships between the air-fuel ratio within the combustion chambers of the engine and a period of time to required for the output value of the $O_2$ sensor to reach from a first voltage threshold to a second voltage threshold during an abnormality determination in a case where the purge is performed during the abnormality determination, for cases where the concentration (learned value) of the evaporated fuel indicates the high concentration, the medium concentration, and the low concentration, respectively.
Figure 7:
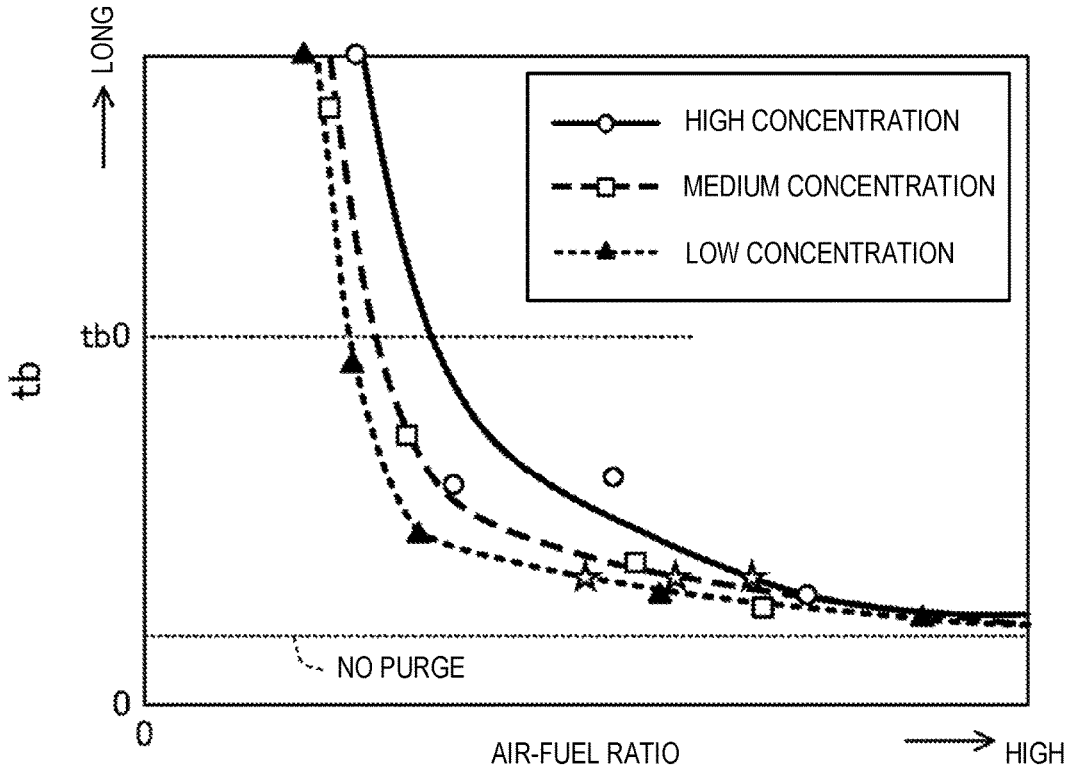
FIG. 7 is a chart illustrating relationships between the air-fuel ratio within the combustion chambers of the engine and a period of time tb required for the output value of the $O_2$ sensor to reach a third voltage threshold from a start of the deceleration fuel cutoff during the abnormality determination in the case where the purge is performed during the abnormality determination, for cases where the concentration (learned value) of the evaporated fuel indicates the high concentration, the medium concentration, and the low concentration, respectively.

FIG. 6 illustrates relationships between the air-fuel ratio within the combustion chambers 6 of the engine 1 and the time period ta during the abnormality determination in the case where the purge is performed during the abnormality determination, for cases where the concentration (learned value) of evaporated fuel indicates the high concentration, the medium concentration, and the low concentration, respectively. Further, FIG. 7 illustrates relationships between the air-fuel ratio within the combustion chambers 6 of the engine 1 and the time period tb required for the output value of the $O_2$ sensor 56 to reach the third voltage threshold V3 from the start of the deceleration fuel cutoff during the abnormality determination in the case where the purge is performed during the abnormality determination, for cases where the concentration (learned value) of evaporated fuel indicates the high concentration, the medium concentration, and the low concentration, respectively.

Based on FIGS. 6 and 7, it can be understood that at each concentration, the time period ta and the time period tb greatly increase once the air-fuel ratio falls below certain ratios (the air-fuel ratios indicated by the star-shaped symbols), respectively. Therefore, in the case of purging during the abnormality determination, by setting the target A/F at each concentration during the abnormality determination to be equal to or larger than the air-fuel ratios indicated by the star-shaped symbols in FIGS. 6 and 7, the purge hardly influences the speed of the change of the output value of the $O_2$ sensor 56 caused by the deceleration fuel cutoff. Specifically, the time period ta and the time period tb in the case where the purge is not performed during the abnormality determination are values indicated by the "NO PURGE" lines in FIGS. 6 and 7, respectively, and by setting the target A/F during the abnormality determination to be equal to or larger than the air-fuel ratios indicated by the star-shaped symbols, the time period ta and the time period tb in the case where the purge is performed during the abnormality determination have no significant difference from those in the case where the purge is not performed during the abnormality determination. In view of increasing the supply amount of the purge gas to the surge tank 34 as much as possible, the target A/F during the abnormality determination is preferably equal or close to the air-fuel ratios indicated by the star-shaped symbols. In this embodiment, since the air-fuel ratio within the combustion chambers 6 changes due to the duty control of the purge valve 75, the target A/F during the abnormality determination is preferably an air-fuel ratio determined by taking into consideration a change amount of the air-fuel ratio caused by the duty control, based on the air-fuel ratio indicated by the star-shaped symbol (an air-fuel ratio obtained by adding, to the air-fuel ratio indicated by the star-shaped symbol, a difference between an average value and a minimum value of the changed air-fuel ratios caused by the duty control).

The relationship between the learned value and the target A/F during the abnormality determination is stored in the memory 90 in advance in the form of a second map (a map in which the target A/F becomes higher as the concentration of the evaporated fuel becomes higher, similar to the first map). In the case of purging during the abnormality determination, the purge restricting module 100*h* calculates the target A/F for during the abnormality determination based on the learned value obtained immediately before the deceleration fuel cutoff by using the second map. With the same learned value, the target A/F during the abnormality determination becomes larger than the target A/F calculated based on the first map in FIG. 4 (the target A/F for other than during the abnormality determination). Further, the purge restricting module 100*h* calculates the purge gas volume qprg based on the calculated target A/F for during the abnormality determination in a manner similar to the manner in which the deceleration-fuel-cutoff purge valve controlling module 100*d* calculates the purge gas volume qprg, and the purge restricting module 100*h* then controls the supply amount of the purge gas to the surge tank 34 (the opening of the purge valve 75) based on the purge gas volume qprg and the pressure difference Pd. Thus, the air-fuel ratio within the combustion chambers 6 of the engine 1 exceeds a predetermined ratio (the air-fuel ratio equal or close to the air-fuel ratios indicated by the star-shaped symbols in FIGS. 6 and 7) so that the time periods to and tb do not significantly increase. Therefore, the purge restricting module 100*h* restricts the purge so that the air-fuel ratio within the combustion chambers 6 of the engine 1 exceeds the predetermined ratio.

As described above, the evaporated fuel concentration estimating module 100*f* estimates the concentration of the evaporated fuel within the purge gas while the purge is performed during the deceleration fuel cutoff, to be the learned value immediately before the deceleration fuel cutoff (the latest learned value stored in the memory 90). Therefore, the concentration of the evaporated fuel within the purge gas when the purge is performed during the abnormality determination is also estimated to be the learned value immediately before the deceleration fuel cutoff. As described above, the purge gas volume qprg calculated by the purge restricting module 100*h* is based on the estimated value (learned value) of the concentration of the evaporated fuel within the purge gas by the evaporated fuel concentration estimating module 100*f*. Therefore, the purge restricting module 100*h* restricts the supply amount of the purge gas to the surge tank 34 controlled by the deceleration-fuel-cutoff purge valve controlling module 100*d*, based on the concentration of the evaporated fuel estimated by the evaporated fuel concentration estimating module 100*f*.

Also in the second map used by the purge restricting module 100*h*, similar to the first map (FIG. 4), the target A/F is not set when the learned value indicates a concentration higher than a predetermined concentration, in other words, when the purge greatly influences the change of the output value of the $O_2$ sensor 56 which is caused by the deceleration fuel cutoff, and in such a case, the purge restricting module 100*h* prohibits the purge.

In this embodiment, as described above, the purge restricting module 100*h* restricts the purge based on the concentration of the evaporated fuel estimated by the evaporated fuel concentration estimating module 100*f*, so that the air-fuel ratio within the combustion chambers 6 of the engine 1 during the abnormality determination exceeds the predetermined ratio; however, the air-fuel ratio estimating module 100*i* may estimate the air-fuel ratio within the combustion chambers 6 of the engine 1 during the abnormality determination in the case where the purge is performed during the abnormality determination, and when the estimated air-fuel ratio is below a preset ratio, the purge restricting module 100*h* may prohibit the purge during the abnormality determination.

In this case, the air-fuel ratio estimating module 100*i* estimates the air-fuel ratio within the combustion chambers 6 of the engine 1 during the abnormality determination in the case where the purge is performed during the abnormality determination, to be the target A/F calculated based on the first map used by the deceleration-fuel-cutoff purge valve controlling module 100*d*. Note that also here, by taking into consideration the change amount of the air-fuel ratio caused by the duty control, the air-fuel ratio within the combustion chambers 6 is preferably estimated to be an air-fuel ratio obtained by subtracting, from the target A/F calculated based on the first map, a difference between an average value and a minimum value of the changed air-fuel ratios caused by the duty control. The preset ratio is set so that the time periods to and tb significantly increase if the air-fuel ratio within the combustion chambers 6 falls below the preset ratio.

Figure 8:
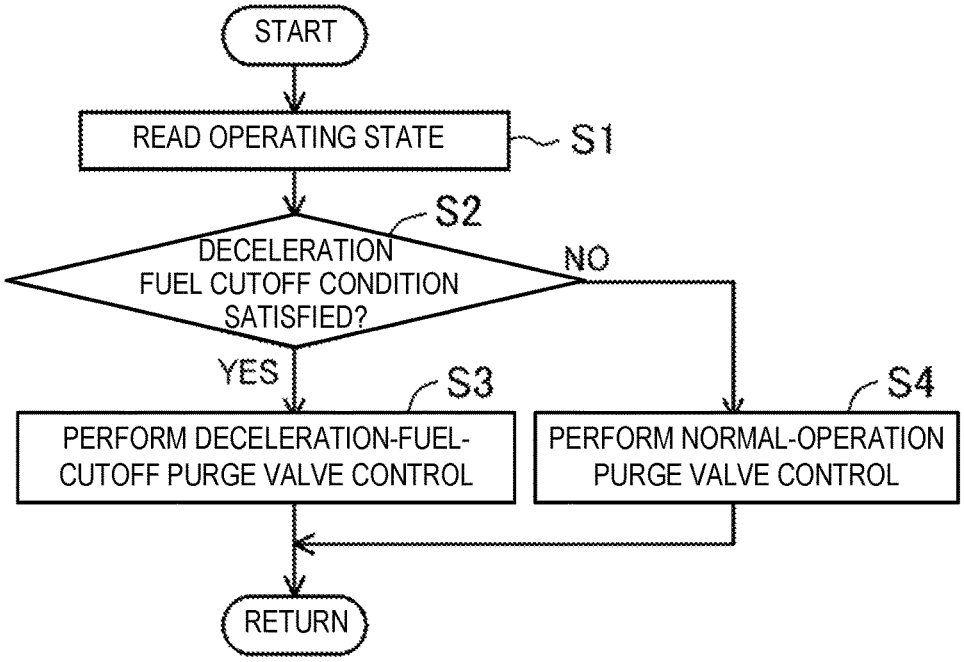
FIG. 8 is a flowchart illustrating a processing operation regarding the purge, performed by the control system.

Next, the processing operation regarding the purge performed by the control system 100 is described with reference to the flowchart in FIG. 8.

First at S1, the operating state of the engine 1 is read, and then at S2, whether the deceleration fuel cutoff condition is satisfied or not is determined.

If the determination result of S2 is positive, the operation proceeds to S3 where the deceleration-fuel-cutoff purge valve control (the control of the purge valve 75 by the deceleration-fuel-cutoff purge valve controlling module 100*d*) is performed, then returns to the start of the operation.

On the other hand, if the determination result of S2 is negative, the operation proceeds to S4 where the normal-operation purge valve control (the control of the purge valve 75 by the normal-operation purge valve controlling module 100*c*) is performed, then returns to the start of the operation.

Figure 9:
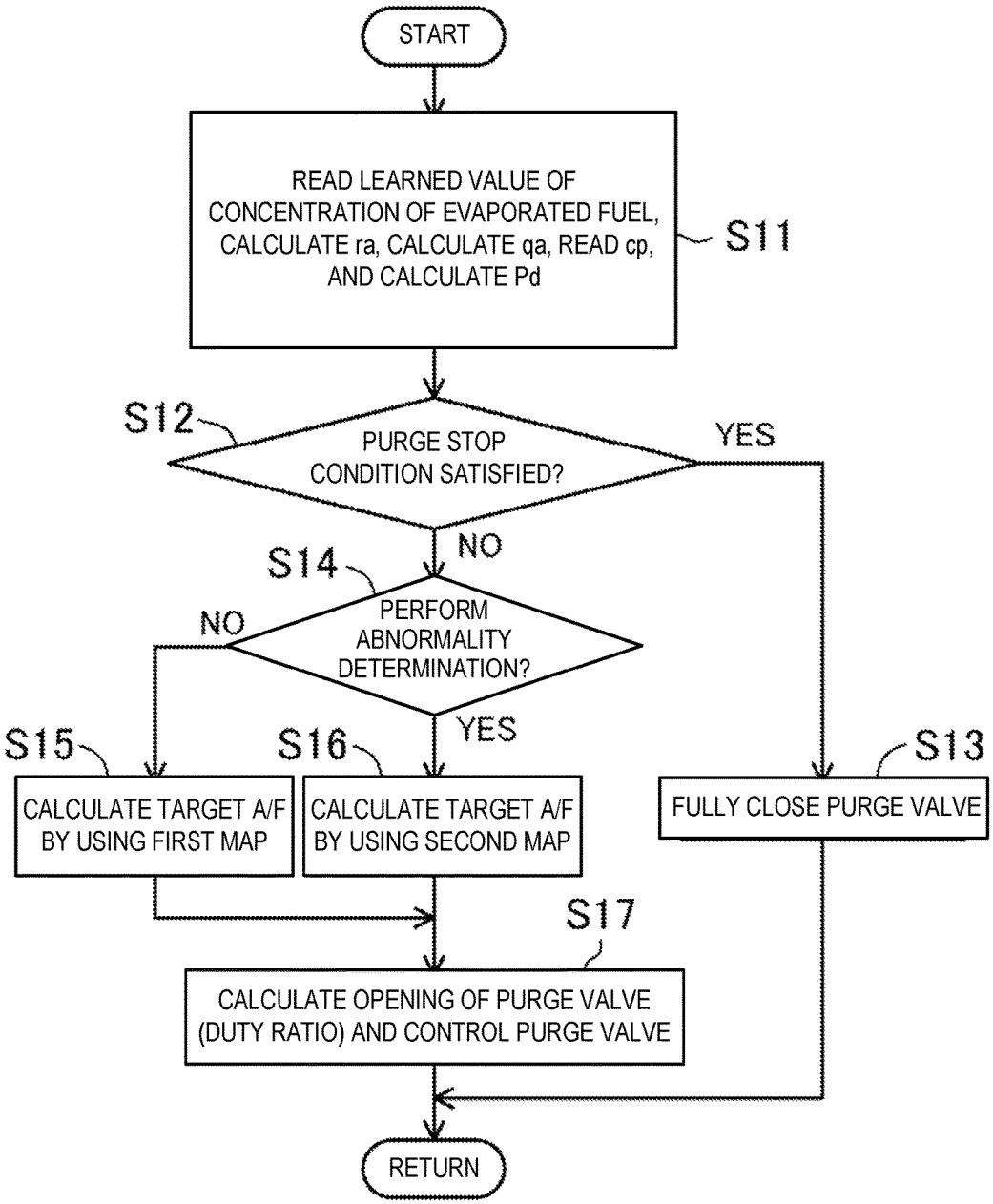
FIG. 9 is a flowchart illustrating a processing operation of a deceleration-fuel-cutoff purge valve control by the control system.

The processing operation of the deceleration-fuel-cutoff purge valve control at S3 is described in more detail with reference to the flowchart in FIG. 9.

First at S11, the learned value of the concentration of the evaporated fuel is read from the memory 90, the mass ratio ra of the evaporated fuel with respect to the entire purge gas is calculated based on the learned value, and the total air mass qa sucked into the combustion chambers 6 is calculated based on the output value of the airflow sensor 32, the mass ratio ra, and the output value of the linear $O_2$ sensor 55. Further, the density cp corresponding to the mass ratio ra is read from the memory 90, and the pressure difference Pd between the detected pressure by the pressure sensor 35 and the detected pressure by the atmospheric pressure sensor 91 is calculated.

Next at S12, whether a purge stop condition is satisfied or not is determined. The purge stop condition is, for example, a condition in which temperatures of the exhaust emission control catalysts 52 and 53 fall below predetermined temperatures when the purge is performed. The predetermined temperatures are set so that purifying performances of the exhaust emission control catalysts 52 and 53 significantly degrade when falling below the predetermined temperatures, respectively (e.g., they are equal or close to activation temperatures of the exhaust emission control catalysts 52 and 53). The temperatures of the exhaust emission control catalysts 52 and 53 may be detected by temperature sensors or estimated when the purge is performed.

If the determination result of S12 is positive, the operation proceeds to S13 where the purge valve 75 is fully closed, then returns to the start of the operation.

On the other hand, if the determination result of S12 is negative, the operation proceeds to S14 where whether the abnormality determination of the $O_2$ sensor 56 is performed or not is determined.

If the determination result of S14 is negative, the operation proceeds to S15 where the target A/F (the target A/F for other than during the abnormality determination) is calculated based on the learned value by using the first map. Here, if the learned value indicates a concentration above the preset concentration C (the hatched section in FIG. 4), the purge is not performed (the purge valve 75 is fully closed). Then the operation proceeds to S17.

On the other hand, if the determination result of S14 is positive, the operation proceeds to S16 where the target A/F (the target A/F during the abnormality determination) is calculated based on the learned value by using the second map. Here, if the learned value indicates a concentration above the predetermined concentration, the purge is not performed (the purge valve 75 is fully closed). Then the operation proceeds to S17.

At S17, the purge gas volume qprg is calculated based on the target A/F set at one of S15 and S16, the mass ratio ra, the total air mass qa, and the density cp, the opening of the purge valve 75 (the duty ratio described above) is calculated based on the purge gas volume qprg and the pressure difference Pd, and the purge valve 75 is controlled to have the calculated opening. Then, the operation returns to the start of the operation.

The processing at S16 to which the operation proceeds when the determination result at S14 is positive, and the processing at S17 which follows S16, are performed by the purge restricting module 100*h* to restrict the purge so that the air-fuel ratio within the combustion chambers 6 of the engine 1 exceeds the predetermined ratio during the abnormality determination.

Figure 10:
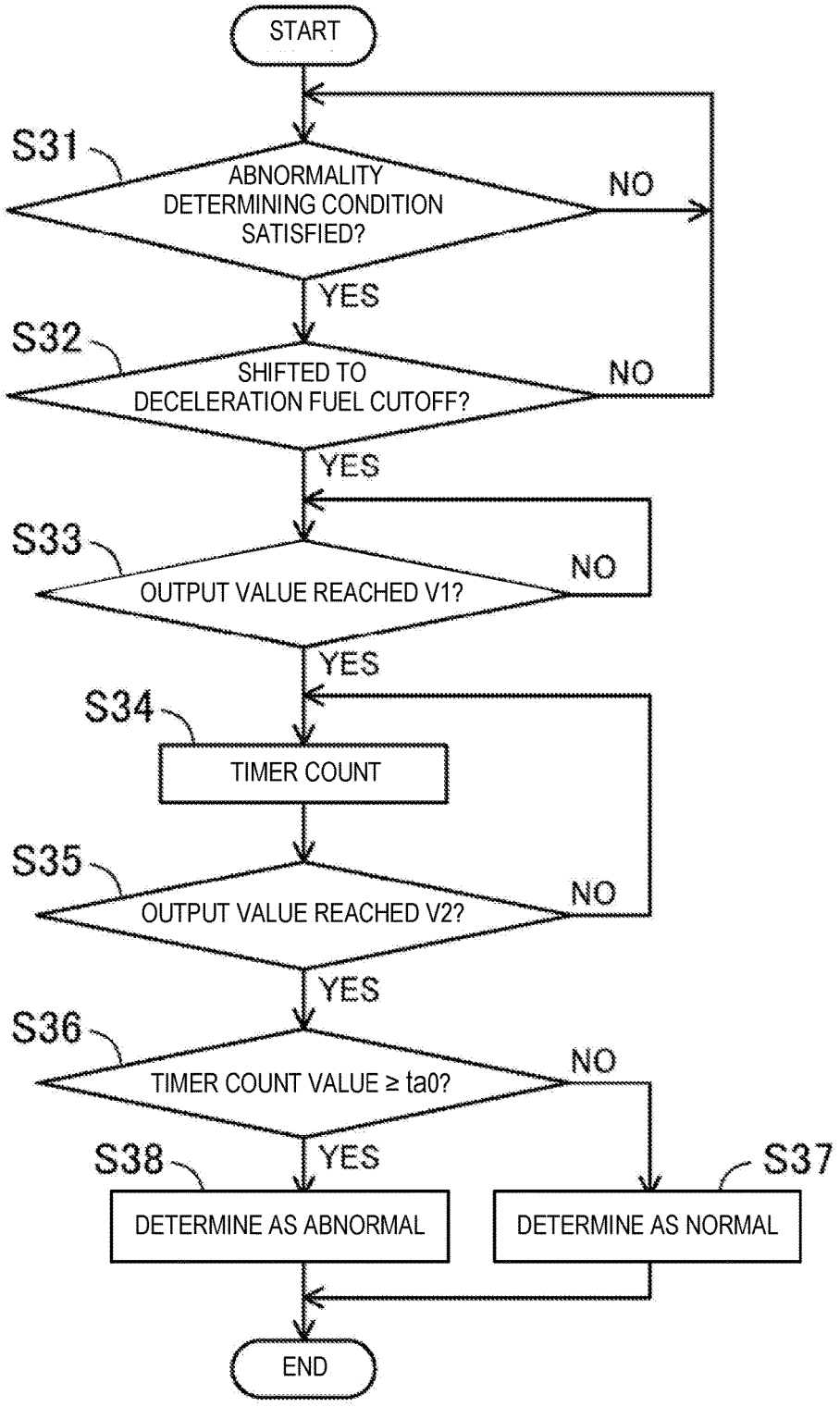
FIG. 10 is a flowchart illustrating a first example of a processing operation of the abnormality determination of the $O_2$ sensor by the control system.

Next, the first example of the processing operation of the abnormality determination of the $O_2$ sensor 56 by the control system 100 (abnormality determining module 100*g*) is described with reference to the flowchart in FIG. 10.

First at S31, whether an abnormality determining condition for performing the abnormality determination is satisfied or not is determined. The abnormality determining condition is a condition in which the deceleration fuel cutoff is not performed and the output value of the $O_2$ sensor 56 is above the first voltage threshold V1.

If the determination result of S31 is negative, the determination at S31 is repeated, whereas if the determination result of S31 is positive, the operation proceeds to S32 where whether the operation of the engine 1 is shifted to the deceleration fuel cutoff is determined.

If the determination result of S32 is negative, the operation returns to S31, whereas if the determination result of S32 is positive, the operation proceeds to S33 where whether the output value of the $O_2$ sensor 56 has reached the first voltage threshold V1 or not is determined.

If the determination result of S33 is negative, the determination at S33 is repeated, whereas if the determination result of S33 is positive, the operation proceeds to S34 where a timer count is started.

Next, at S35, whether the output value of the $O_2$ sensor 56 has reached the second voltage threshold V2 or not is determined. If the determination result of S35 is negative, the operation returns to S34, whereas if the determination result of S35 is positive, the operation proceeds to S36.

At S36, whether the timer count value is counted up to the first predetermined time period ta0 or not is determined. If the determination result of S36 is negative, the operation proceeds to S37 where the $O_2$ sensor 56 is determined as normal, and then the processing operation of the abnormality determination is ended. On the other hand, if the determination result of S36 is positive, the operation proceeds to S38 where the $O_2$ sensor 56 is determined as abnormal, and then the processing operation of the abnormality determination is ended.

Figure 11:
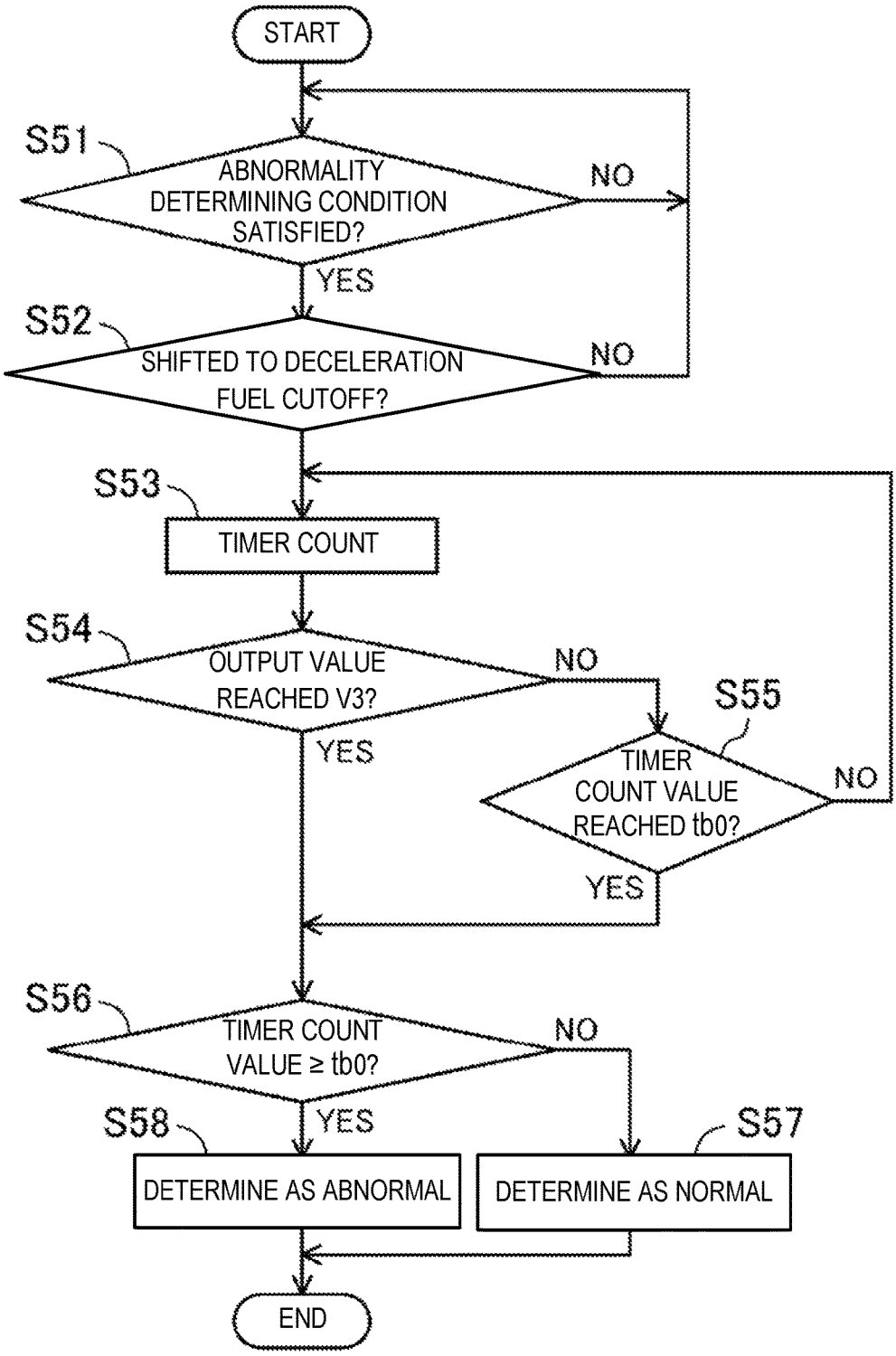
FIG. 11 is a flowchart illustrating a second example of a processing operation of the abnormality determination of the $O_2$ sensor by the control system.

The second example of the processing operation of the abnormality determination of the $O_2$ sensor 56 by the control system 100 (abnormality determining module 100*g*) is as illustrated in the flowchart in FIG. 11.

Specifically, processing similar to S31 and S32 is performed at S51 and S52, respectively, and if the determination result of S52 is positive, the operation proceeds to S53 where a timer count is started.

Next, at S54, whether the output value of the $O_2$ sensor 56 has reached the third voltage threshold V3 or not is determined. If the determination result of S54 is negative, the operation proceeds to S55, whereas if the determination result of S54 is positive, the operation proceeds to S56.

At S55, whether the timer count value is counted up to the second predetermined time period tb0 or not is determined. If the determination result of S55 is negative, the operation returns to S53, whereas if the determination result of S55 is positive, the operation proceeds to S56.

At S56, whether the timer count value is counted up to the second predetermined time period tb0 or not is determined. If the processing at S56 is performed after the determination at S55 resulted in being positive, the determination result of S56 naturally becomes positive.

If the determination result of S56 is negative, the operation proceeds to S57 where the $O_2$ sensor 56 is determined as normal, and then the processing operation of the abnormality determination is ended. On the other hand, if the determination result of S56 is positive, the operation proceeds to S58 where the $O_2$ sensor 56 is determined as abnormal, and then the processing operation of the abnormality determination is ended.

Therefore, in this embodiment, the purge performed by the deceleration-fuel-cutoff purge valve controlling module 100*d* is restricted (the purge is prohibited or the supply amount of the purge gas to the surge tank 34 is restricted) during the abnormality determination performed by the abnormality determining module 100*g* to determine whether the $O_2$ sensor 56 is abnormal based on the change of the output value of the $O_2$ sensor 56 caused by the deceleration fuel cutoff of the engine 1. Therefore, the degradation in accuracy of the abnormality determination of the $O_2$ sensor 56 due to the purge can be suppressed.

The present invention is not limited to the above embodiment, and may be substituted without deviating from the scope of the claims.

The above-described embodiment is merely an illustration, and therefore, the present invention must not be interpreted in a limited way. The scope of the present invention is defined by the claims, and all of modifications and changes falling under the equivalent range of the claims are within the scope of the present invention.

The present invention is useful for performing, with a control system of an engine in which a purge gas containing evaporated fuel desorbed from a canister is supplied to an intake passage, a purge during a deceleration fuel cutoff of the engine and an abnormality determination in which whether an $O_2$ sensor is abnormal is determined based on a change of an output value of the $O_2$ sensor caused by the deceleration fuel cutoff.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

LIST OF REFERENCE CHARACTERS

1 Engine
30 Intake Passage
40 Exhaust Passage
56 $O_2$ Sensor
70 Canister
73 Purge Tube (Purge Line) (Purge Unit)
75 Purge Valve (Purge Unit)
**100*d*** Deceleration-fuel-cutoff Purge Valve Controlling Module (Purge Valve Controlling Module) (Purge Unit)
**100*e*** Deceleration-fuel-cutoff Controlling Module (Deceleration Fuel Cutoff Module)
**100*f*** Evaporated Fuel Concentration Estimating Module
**100*g*** Abnormality Determining Module
**100*h*** Purge Restricting Module
**100*i*** Air-fuel Ratio Estimating Module

What is claimed is:

1. A control system of an engine in which a purge gas containing evaporated fuel desorbed from a canister is supplied to an intake passage of the engine, the control system comprising:

a deceleration fuel cutoff module for performing a deceleration fuel cutoff to stop a fuel supply from an injector to the engine when a predetermined deceleration fuel cutoff condition is satisfied in a decelerating state of the engine;

a purge unit for performing a purge by supplying the purge gas to the intake passage during the deceleration fuel cutoff;

an $O_2$ sensor provided in an exhaust passage of the engine;

an abnormality determining module for performing an abnormality determination by determining an abnormality of the $O_2$ sensor based on a change of an output value of the $O_2$ sensor that is caused by the deceleration fuel cutoff; and a purge restricting module for restricting the purge during the abnormality determination.

2. The control system of claim 1, wherein during the abnormality determination, the purge restricting module restricts the purge so that an air-fuel ratio within a combustion chamber of the engine exceeds a predetermined ratio.

3. The control system of claim 1, further comprising an air-fuel ratio estimating module for estimating an air-fuel ratio within a combustion chamber of the engine during the abnormality determination in a case where the purge is performed during the abnormality determination, wherein the purge restricting module prohibits the purge during the abnormality determination when the estimated air-fuel ratio is below a preset ratio.

4. The control system of claim 1, wherein the purge unit includes a purge line through which the canister communicates with the intake passage, a purge valve provided in the purge line, and a purge valve controlling module for controlling a supply amount of the purge gas to the intake passage by performing a duty control of the purge valve when the purge is performed, the control system further comprising an evaporated fuel concentration estimating module for estimating a concentration of the evaporated fuel within the purge gas when the purge is performed during the abnormality determination, wherein during the abnormality determination, the purge restricting module restricts the supply amount of the purge gas to the intake passage based on the estimated concentration of the evaporated fuel.

5. The control system of claim 4, wherein when the estimated concentration of the evaporated fuel is above a predetermined concentration, the purge restricting module prohibits the purge during the abnormality determination.

6. The control system of claim 2, wherein the purge unit includes a purge line through which the canister communicates with the intake passage, a purge valve provided in the purge line, and a purge valve controlling module for controlling a supply amount of the purge gas to the intake passage by performing a duty control of the purge valve when the purge is performed, the control system further comprising an evaporated fuel concentration estimating module for estimating a concentration of the evaporated fuel within the purge gas when the purge is performed during the abnormality determination, wherein during the abnormality determination, the purge restricting module restricts the supply amount of the purge gas to the intake passage based on the estimated concentration of the evaporated fuel.

7. The control system of claim 6, wherein when the estimated concentration of the evaporated fuel is above a predetermined concentration, the purge restricting module prohibits the purge during the abnormality determination.

8. The control system of claim 3, wherein the purge unit includes a purge line through which the canister communicates with the intake passage, a purge valve provided in the purge line, and a purge valve controlling module for controlling a supply amount of the purge gas to the intake passage by performing a duty control of the purge valve when the purge is performed, the control system further comprising an evaporated fuel concentration estimating module for estimating a concentration of the evaporated fuel within the purge gas when the purge is performed during the abnormality determination, wherein during the abnormality determination, the purge restricting module restricts the supply amount of the purge gas to the intake passage based on the estimated concentration of the evaporated fuel.

9. The control system of claim 8, wherein when the estimated concentration of the evaporated fuel is above a predetermined concentration, the purge restricting module prohibits the purge during the abnormality determination.

10. A control system of an engine in which a purge gas containing evaporated fuel desorbed from a canister is supplied to an intake passage of the engine, the control system comprising:

a deceleration fuel cutoff module for performing a deceleration fuel cutoff to stop a fuel supply from an injector to the engine when a predetermined deceleration fuel cutoff condition is satisfied in a decelerating state of the engine;

a purge unit for performing a purge by supplying the purge gas to the intake passage during the deceleration fuel cutoff;

an $O_2$ sensor provided in an exhaust passage of the engine;

an abnormality determining module for performing an abnormality determination by determining an abnormality of the $O_2$ sensor based on a response time of an output value of the $O_2$ sensor that is caused by the deceleration fuel cutoff; and a purge restricting module for restricting the purge during the abnormality determination.

11. The control system of claim 10, the abnormality determining module determines the abnormality of the $O_2$ sensor when the response time is longer than a predetermined length of time.

* * * * *